US005094038A

United States Patent [19]

Maruyama

[11] Patent Number: 5,094,038

[45] Date of Patent: Mar. 10, 1992

[54] SHARPENING AID

[76] Inventor: Shoji Maruyama, 4001 N. 9th St., Apt 1327, Arlington, Va. 22203

[21] Appl. No.: 464,940

[22] Filed: Jan. 16, 1990

[51] Int. Cl.[5] ..... B24B 41/06; B24B 3/36

[52] U.S. Cl. ..... 51/216 A; 51/218 A; 269/296

[58] Field of Search ..... 51/216 R, 216 P, 216 A, 51/217 R, 217 P, 217 A, 218 R, 218 P, 318 A, 221 BS, 285, 238 S, 222, 224, 212; 269/289 R, 296, 303

[56] References Cited

U.S. PATENT DOCUMENTS

| | | | |
|---|---|---|---|
| 945,771 | 1/1910 | Ensminger | 51/285 X |
| 2,723,515 | 11/1955 | Stuck | 51/285 |

FOREIGN PATENT DOCUMENTS

| | | | |
|---|---|---|---|
| 0779219 | 4/1935 | France | 51/212 |
| 5871051 | 4/1983 | Japan | 51/218 R |
| 0127158 | 1/1919 | United Kingdom | 51/285 |

*Primary Examiner*—Maurina Rachura
*Assistant Examiner*—Bruce P. Watson
*Attorney, Agent, or Firm*—Fred Philpitt

[57] ABSTRACT

A support device for facilitating the sharpening of a knife blade or the like is provided. The device is a solid block of rigid material having a flat lower surface to rest on a stable surface and an upper surface parallel to the lower surface. The upper surface has an elongated arcuate channel therein which extends the length of the block. Two spaced apart lips extend horizontally along the upper edges of the channel and extend slightly inwardly of the upper edges of the channel towards each other. A knife having a width greater than the width of the channel is inserted into the channel with its cutting edge extending out of the channel for sharpening, its non-cutting edge abutting against one of the lips, and the side if the knife abutting against the other lip. Thus the knife is held at the proper angle for sharpening with a stone.

1 Claim, 1 Drawing Sheet

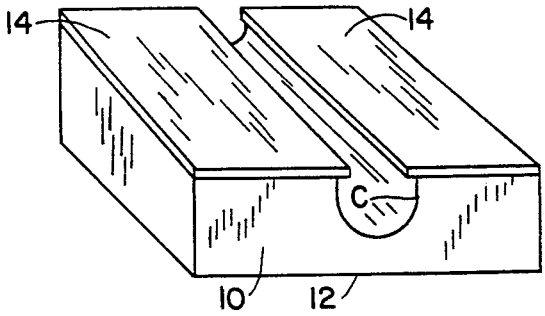
FIG. 1
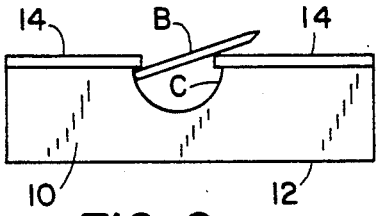
FIG. 2
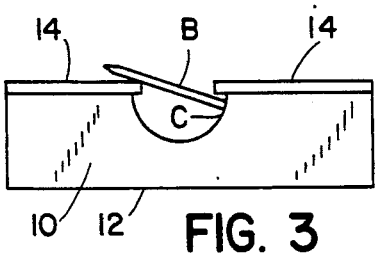
FIG. 3
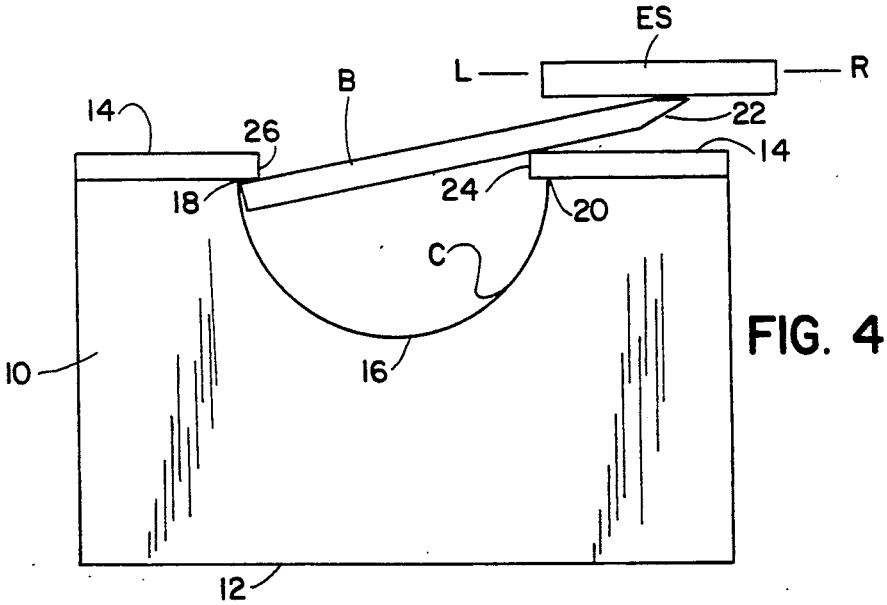
FIG. 4
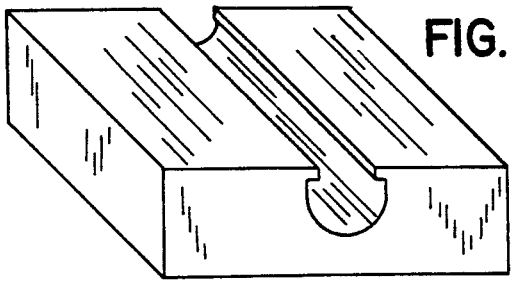
FIG. 5
FIG. 6
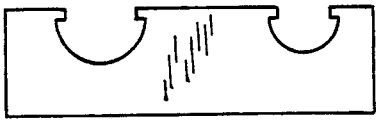

SHARPENING AID

BACKGROUND OF THE INVENTION

The majority of knives in homes are sharpened by holding the knife in one hand and an emery stone in the other, and the two are rubbed together in a rather haphazard fashion until it is felt that the blade has been sharpened. The difficulty with this is that the angle of contact between the blade and the emery stone varies a great deal because most people do not have any idea as to what the optimum angle of contact between the blade and the emery stone is. As a result the knife is seldom sharpened in an optimal way.

SUMMARY OF THE INVENTION

An object of my invention is to provide a device into which a knife blade can be placed so that the cutting edge of the blade will be positioned so that it can be sharpened by moving an emery stone in an essentially horizontal plane over the cutting edge. Other objects of my invention will be apparent after reading the following description in conjunction with the attached drawings wherein

BRIEF DESCRIPTION OF THE DRAWINGS

FIG. 1 is a perspective view of a first embodiment of my invention;

FIGS. 2 and 3 are end views of the device of FIG. 1 showing how a knife blade can be positioned so that first one side of the cutting edge is positioned for sharpening and then the other side of the cutting edge is positioned for sharpening;

FIG. 4 is an enlarged view of FIG. 2 showing the relationship of an emery stone to the cutting edge of a blade;

FIG. 5 is a perspective view of a second embodiment of my invention;

FIG. 6 is a perspective view of a third embodiment of my invention;

DETAILED DESCRIPTION OF THE PREFERRED EMBODIMENT

Considered from one aspect my invention relates to a device for facilitating the sharpening of a knife blade or the like comprising (a) a solid base member of rigid material having a lower flat surface that is adapted to rest on a stable horizontal support, said solid base member having an upper surface that is substantially parallel to said lower flat surface, (b) an elongated channel extending across and through an upper portion of said solid base member, said elongated channel diverging from a low point located beneath said upper surface of said solid base member upwardly and outwardly to two spaced apart upper edges adjacent said upper surface of the solid base member, said channel being sized and shaped to accommodate a blade in such a way (1) so that the cutting edge of the blade will always extend out of said channel and above said upper surface of the solid base member, and (2) so that the knife can be rotated through an arc of at least about 90[ so that first one side of the cutting edge can be positioned for sharpening and after rotation the opposite side of the cutting edge can be positioned for sharpening, (c) spaced apart lip means extending along said upper edges of said elongated channel and slightly inwardly of said upper edges so as to establish limiting abutment means for the non-cutting back portion of a blade, said lip means serving to both (1) limit the extent to which a blade can be turned or rotated within said channel, and (2) establish the angle at which the cutting edge of a blade will be angularly disposed with respect to the upper surface of said solid base member.

Referring now to the drawings it is seen that my device is preferably formed from a solid base member 10 that is composed of any fairly rigid material such as plastic, wood, metal, ceramic, etc. The solid base member 10 can be of any shape, but preferred shapes would be either rectangular or square. The solid base member 10 preferably has a flat lower surface 12 that is adapted to rest on a stable horizontal support such as a tabletop, countertop, bench or the like. The solid base member 10 has an upper surface 14 that is substantially parallel to said lower flat surface 12.

An elongated channel C extends across and through an upper portion of said solid base member 10. As shown, the channel C diverges from a low point 16 upwardly and outwardly to two spaced apart upper edges 18 and 20 which are adjacent the upper surface 14 of said solid base member. The channel C is sized and shaped to accommodate a blade B in such a way that the cutting edge 22 of the blade B will always extend outside the channel C and above the upper surface 14 of the solid base member 10 so that the knife can be rotated through an arc of at least about 90 degrees and so that first one side of the cutting edge can be positioned for sharpening and after rotation the opposite side of the cutting edge can be positioned for sharpening. The preferred cross-sectional contour of the channel C is arcuate or somewhat semicircular as shown because this permits one to quickly and simply rotate a blade from the position shown in FIG. 2 to the position shown in FIG. 3. However, any other shape or contour for the channel C can be selected which would permit one to start with the blade B in the position shown in FIG. 2 and then change to the position shown in FIG. 3.

Spaced apart lip means 24 and 26 are provided which extend along the upper edges 18 and 20 of the elongated channel C and slightly inwardly of said upper edges 18 and 20 so as to establish limiting abutment means for the non-cutting back portion of the blade B. Lip means 24 and 26 serve to both limit the extent to which the blade B can be turned or rotated within said channel and also establish the angle at which the cutting edge of the blade B will be angularly disposed with respect to the upper surface 14 of the base member 10. As is shown in FIG. 4, a preferred positioning of the lip means 24 and 26 is so that the upper side of the cutting edge 22 that is to be sharpened will first be disposed in a position which is horizontal or generally parallel to the top surface 14. This enables the person who is sharpening the blade to achieve proper honing of the blade by simply always moving the grinding means, such as an emery stone ES, in a horizontal direction L or R (or both L and R) without having to worry about adjusting the presenting angle of the blade. This not only speeds up the sharpening operation, but also eliminates undesired variability in the presenting position of the emery stone ES.

As is shown in FIG. 1 the solid base member can be composed of two separate components that can be joined together in any suitable way, such as by bonding together with an adhesive or with screws or the like.

However, the solid base member can also be made from a single piece of plastic, wood, ceramic or the like by molding, lathing, casting, etc., as is shown in FIG. 5.

As shown in FIG. 6 my sharpening device may be provided with a number of different sized elongated channels so as to accommodate knife blades of different sizes.

Another substantial advantage of my device is that is permits one to apply greater pressure or force between the edge of a knife blade and an emery stone during the course of the sharpening process—as compared to the conventional sharpening process wherein the knife is held in one hand and the emery stone in the other.

What I claim is:

1. A support device for alternately supporting a knife blade in either of two positions so that both sides of the cutting edge of the blade can be sharpened, said two positions including (1) a first position whereby a first side of the blade cutting edge can be sharpened, and (2) a second position whereby a second side of the blade cutting edge can be sharpened, said support device consisting of a single, unitary block-like mass of rigid material that (a) has a lower flat surface that is adapted to rest on a stable horizontal support, and an upper surface that is substantially parallel to said lower flat surface, (b) an elongated channel extending in a single fixed location across and through an upper portion of said blocklike mass of rigid material, said elongated channel being sized and shaped to accommodate a blade in such a way that the cutting edge of the blade to be sharpened will always extend out of said elongated channel and above said upper surface of the block-like mass of rigid material, the maximum width of said channel being less than the width of the knife blade that is to be sharpened in said device, and two spaced apart lip means extending horizontally along upper edges of said elongated channel and slightly inwardly of said upper edges toward each other so as to partially overhang said channel and so as to establish limiting abutment means for the non-cutting back edge of a blade, said two spaced apart lip means serving to both (1) limit the extent to which both the cutting edge and the back edge of a blade can be turned or rotated within said elongated channel, and (2) establish the angle at which the cutting edge of a blade will be angularly disposed with respect to the upper surface of said block-like mass of rigid material, and the distance between said two spaced apart lip means being less than the width of the knife blade that is to be sharpened in said device.

* * * * *